US008342111B2

(12) United States Patent
Hamajima

(10) Patent No.: US 8,342,111 B2
(45) Date of Patent: Jan. 1, 2013

(54) SEWING MACHINE AND COMPUTER-READABLE MEDIUM STORING CONTROL PROGRAM EXECUTABLE IN SEWING MACHINE

(75) Inventor: Eiichi Hamajima, Kasugai (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 960 days.

(21) Appl. No.: 12/382,475

(22) Filed: Mar. 17, 2009

(65) Prior Publication Data

US 2009/0235855 A1 Sep. 24, 2009

(30) Foreign Application Priority Data

Mar. 20, 2008 (JP) ..... 2008-072652

(51) Int. Cl.
*D05B 69/36* (2006.01)

(52) U.S. Cl. ..... 112/275

(58) Field of Classification Search ..... 112/470.01, 112/444, 445, 274, 275; 700/136–138
See application file for complete search history.

(56) References Cited

U.S. PATENT DOCUMENTS

| | | | | |
|---|---|---|---|---|
| 4,763,589 | A * | 8/1988 | Laidig et al. | 112/278 |
| 6,832,841 | B2 * | 12/2004 | Kitakata | 112/278 |
| 2007/0221106 | A1 * | 9/2007 | Nishida et al. | 112/2 |

FOREIGN PATENT DOCUMENTS

| | | |
|---|---|---|
| CN | C-1126835 | 11/2003 |
| CN | A-1699663 | 11/2005 |
| JP | A-57-12188 | 1/1982 |
| JP | A-2-104389 | 4/1990 |
| JP | A-2-104390 | 4/1990 |
| JP | A-2-305592 | 12/1990 |
| JP | A-6-91085 | 4/1994 |
| JP | A-2000-317187 | 11/2000 |
| JP | A-2003-320188 | 11/2003 |
| JP | A-2005-304724 | 11/2005 |

* cited by examiner

*Primary Examiner* — Nathan Durham

(74) *Attorney, Agent, or Firm* — Oliff & Berridge, PLC

(57) ABSTRACT

A sewing machine that operates with power supplied from a main power supply includes a needle plate having a needle hole through which a sewing needle can pass, an illuminating device that illuminates the needle hole and a vicinity of the needle hole, a power supply device that stores power, a detection device that detects whether a predetermined operation is performed in the sewing machine, a power distribution device that supplies the power from the power supply device to the detection device and the illuminating device, if supply of the power from the main power supply is turned off, and a turning-on device that turns on the illuminating device, if the detection device detects that the predetermined operation is performed in a condition where the supply of the power from the main power supply is cut off.

9 Claims, 13 Drawing Sheets

SEWING MACHINE AND COMPUTER-READABLE MEDIUM STORING CONTROL PROGRAM EXECUTABLE IN SEWING MACHINE

CROSS-REFERENCE TO RELATED APPLICATION

This application claims priority to JP 2008-072652, filed Mar. 20, 2008, the content of which is hereby incorporated herein by reference in its entirety.

BACKGROUND

The present disclosure relates to a sewing machine. More specifically, the present disclosure relates to a sewing machine equipped with an illuminating device and a computer-readable medium storing a control program that is executable in the sewing machine.

Conventionally, a sewing machine equipped with an illuminating device mounted with an LED (Light Emitting Diode) is known. The LED may illuminate a needle hole (needle drop position), which is formed in a needle plate and through which a sewing needle can be inserted, and the vicinity of the needle hole (see, for example, Japanese Patent Application Laid-Open Publication No. 2000-317187). Another type of sewing machine equipped with an illuminating device mounted with a light emitting device is also known. The light emitting device may emit light upward from the lower side of a folded cloth when a user raises a presser foot, in order to enable the user to visually recognize an edge of the cloth folded underneath (see, for example, Japanese Patent Application Laid-Open No. 2000-320188).

SUMMARY

In such conventional sewing machines, the illuminating device is supplied with power from a main power supply. Therefore, the user can turn on the illuminating device only when the main power supply is on. Further, components such as the sewing needle and the presser foot may be replaced. When replacing such a component, the user needs to turn off the main power in order to prevent the sewing machine from operating while the user is replacing a component, thereby ensuring safety of the user. However, if the main power is turned off, the supply of power is also turned off, so that the illuminating device cannot be turned on. As a result, the vicinity of the needle drop position may become dark, thus making it difficult for the user to replace the component.

Various exemplary embodiments of the broad principles described herein provide a sewing machine equipped with an illuminating device that makes it easy for a user to replace a component such as a sewing needle and a presser foot while ensuring safety of the user, and a computer-readable medium storing a control program which is executable in the sewing machine.

Exemplary embodiments provide a sewing machine that operates with power supplied from a main power supply. The sewing machine includes a needle plate having a needle hole through which a sewing needle can pass, an illuminating device that illuminates the needle hole and a vicinity of the needle hole, a power supply device that stores power. The sewing machine also includes a detection device that detects whether a predetermined operation is performed in the sewing machine, and a power distribution device that supplies the power from the power supply device to the detection device and the illuminating device, if supply of the power from the main power supply is turned off. The sewing machine further includes a turning-on device that turns on the illuminating device, if the detection device detects that the predetermined operation is performed in a condition where the supply of the power from the main power supply is turned off.

Exemplary embodiments also provide a computer-readable medium storing a control program executable in a sewing machine that operates with power supplied from a main power supply. The program includes instructions that cause a controller of the sewing machine to perform the step of causing a power supply device that stores power to supply the stored power to a detection device and an illuminating device that are provided in the sewing machine. The detection device is configured to detect whether a predetermined operation is performed in the sewing machine, and the illuminating device is configured to illuminate a needle hole and a vicinity of the needle hole. The needle hole is a hole formed in a needle plate through which a sewing needle can pass. The program also includes instructions that cause a controller of the sewing machine to perform the step of turning on the illuminating device, if it is detected that the predetermined operation is performed in a condition where the main power supply is turned off.

BRIEF DESCRIPTION OF THE DRAWINGS

Exemplary embodiments will be described below in detail with reference to the accompanying drawings.

DETAILED DESCRIPTION OF EMBODIMENTS

A sewing machine 1 according to an embodiment will be described below, with reference to the drawings. First, the configuration of the sewing machine 1 will be described with reference to FIGS. 1 to 3. In the following description, in FIG. 1, the side of the paper toward the viewer is referred to as the "front side of the sewing machine 1" and the opposite side thereof is referred to as the "rear side of the sewing machine 1". Also, in FIG. 1, the left side of the paper as viewed from the viewer is referred to as the "left side of the sewing machine 1" and the right side thereof is referred to as the "right side of the sewing machine 1".

Figure 1:
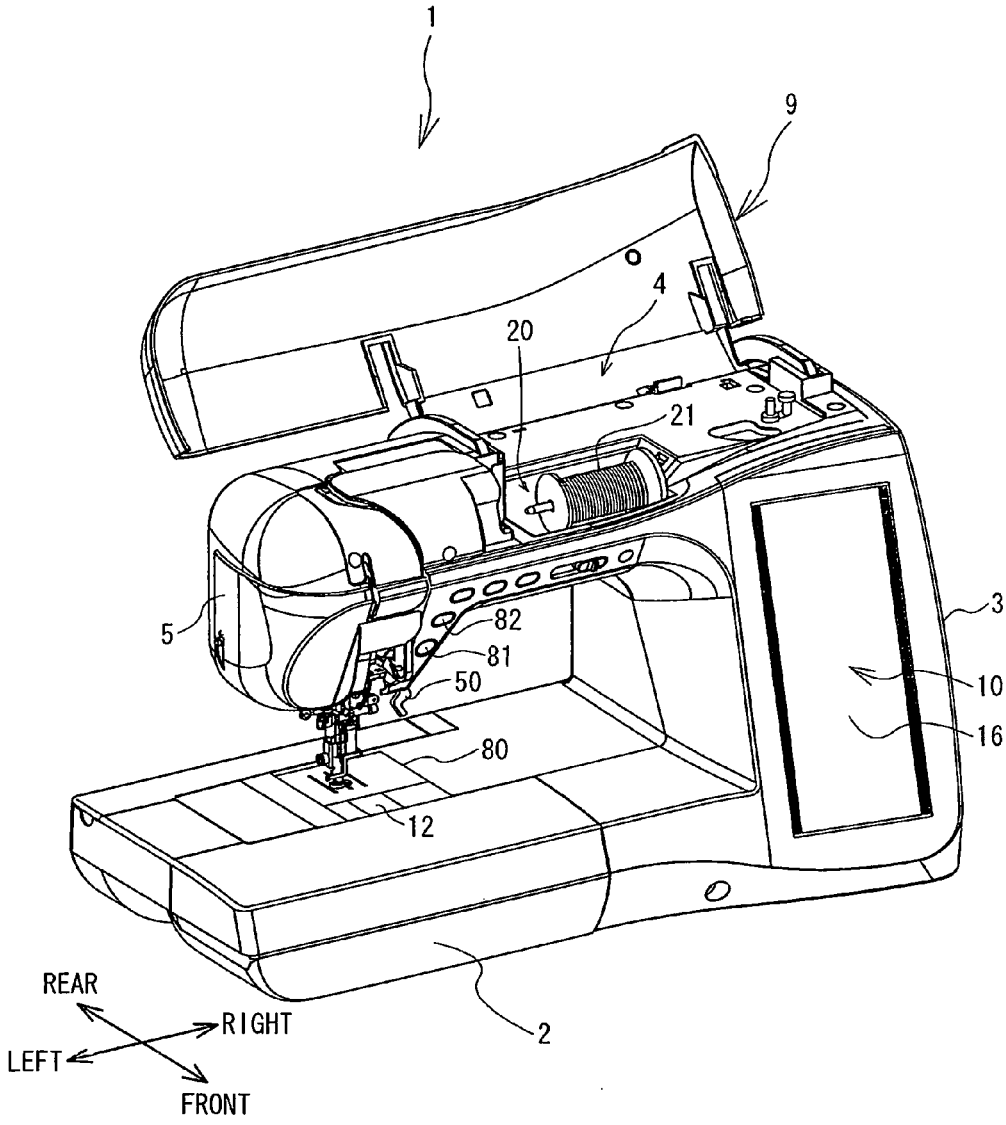
FIG. 1 is a perspective view of a sewing machine.
Figure 2:
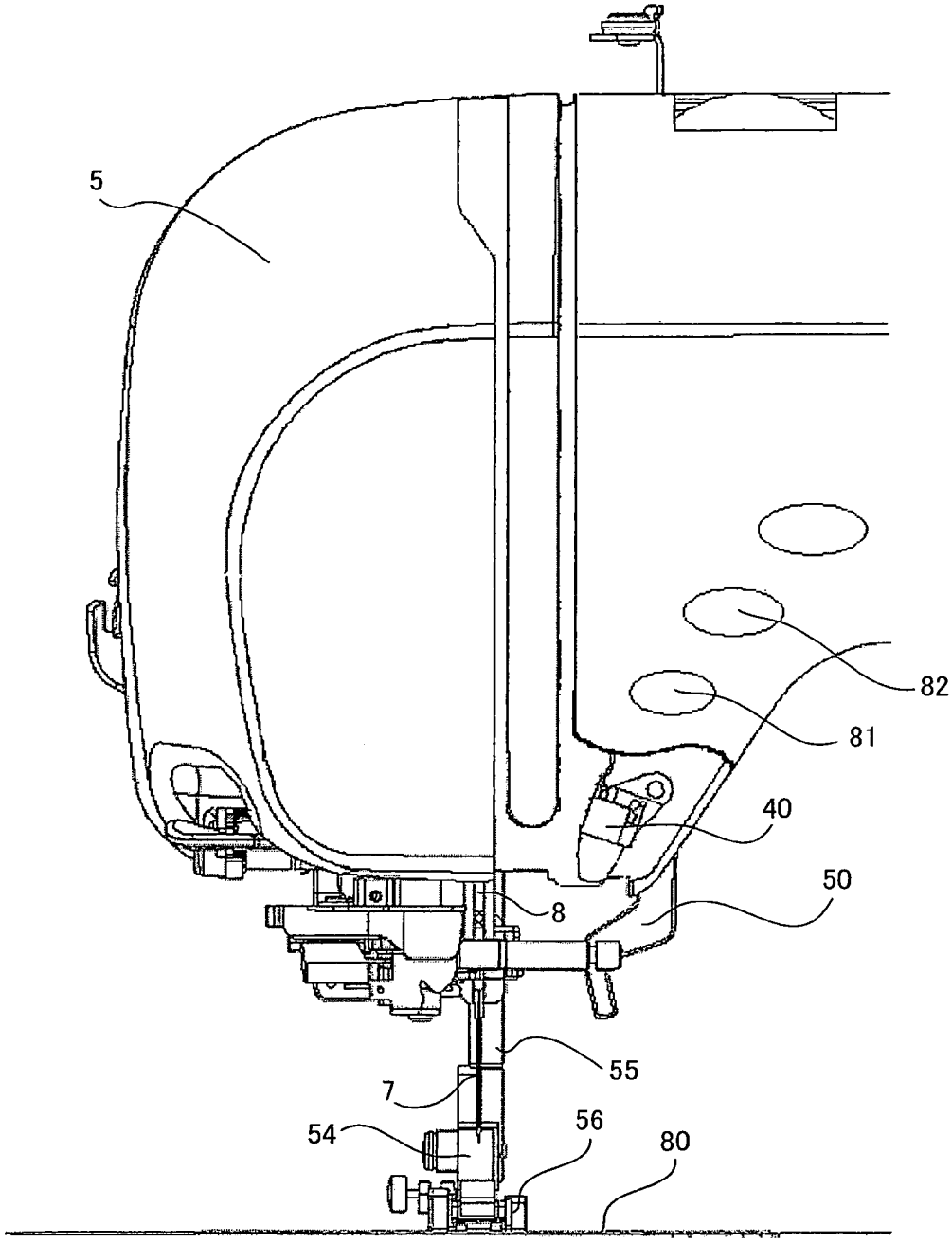
FIG. 2 is a front view of a head portion and the vicinity of the head portion.

As shown in FIG. 1, the sewing machine 1 has a sewing machine bed 2 which is long in the right-and-left direction, a pillar 3, an arm 4, and a head portion 5. The pillar 3 is erected upward at the right end of the sewing machine bed 2. The arm 4 extends leftward from an upper end of the pillar 3. The head portion 5 is provided at a left end of the arm 4. As shown in FIG. 2, the head portion 5 may include a sewing needle 7, a presser bar 55, a presser foot holder 54, a presser foot 56, and a presser foot lever 50. The sewing needle 7 may be attached to a lower end of the needle bar 8. The presser bar 55 is disposed at the rear part in the vicinity of the sewing needle 7 in such a manner that the presser bar 55 can be raised and lowered. The presser foot holder 54 may be fixed to the lower end of the presser bar 55. The presser foot 56 may be attached to the presser foot holder 54. The presser foot 56 can be attached to and detached from the presser foot holder 54. The presser foot 56 may be used to hold down a work cloth, which is a target for sewing. The presser foot lever 50 may be used to raise or lower the presser foot 56. On the front surface of the head portion 5, a sewing start switch 81 and a sewing stop switch 82 are provided. The sewing start switch 81 may be used to start sewing. The sewing stop switch 82 may be used to stop sewing. Below the sewing start switch 81 in the head portion 5, a white LED 40 that illuminates a needle hole 79 (see FIG. 12) and the vicinity thereof is fixed. The needle hole 79 is formed in a needle plate 80 and the sewing needle 7 may pass through the needle hole 79. In the present embodiment, the white LED 40 is employed for the illuminating device to save on power to be consumed during the time when the illuminating device stays on. However, the illuminating device is not limited to a white LED.

As shown in FIG. 1, at a midsection in an upper part of the arm 4, a needle-thread housing 20 is provided. The needle-thread housing 20 may contain a thread spool 21 around which a needle thread is wound. An arm cover 9 to cover the upper part of the arm 4 is pivotally supported by a pivot shaft (not shown) in such a manner that the arm cover 9 can be opened and closed. The pivot shaft is mounted to a rear end part of the upper part of the arm 4. The head portion 5 is mounted with a tensioner (not shown). The tensioner has a pair of tension discs (not shown) to sandwich the needle thread to apply tension.

Figure 3:
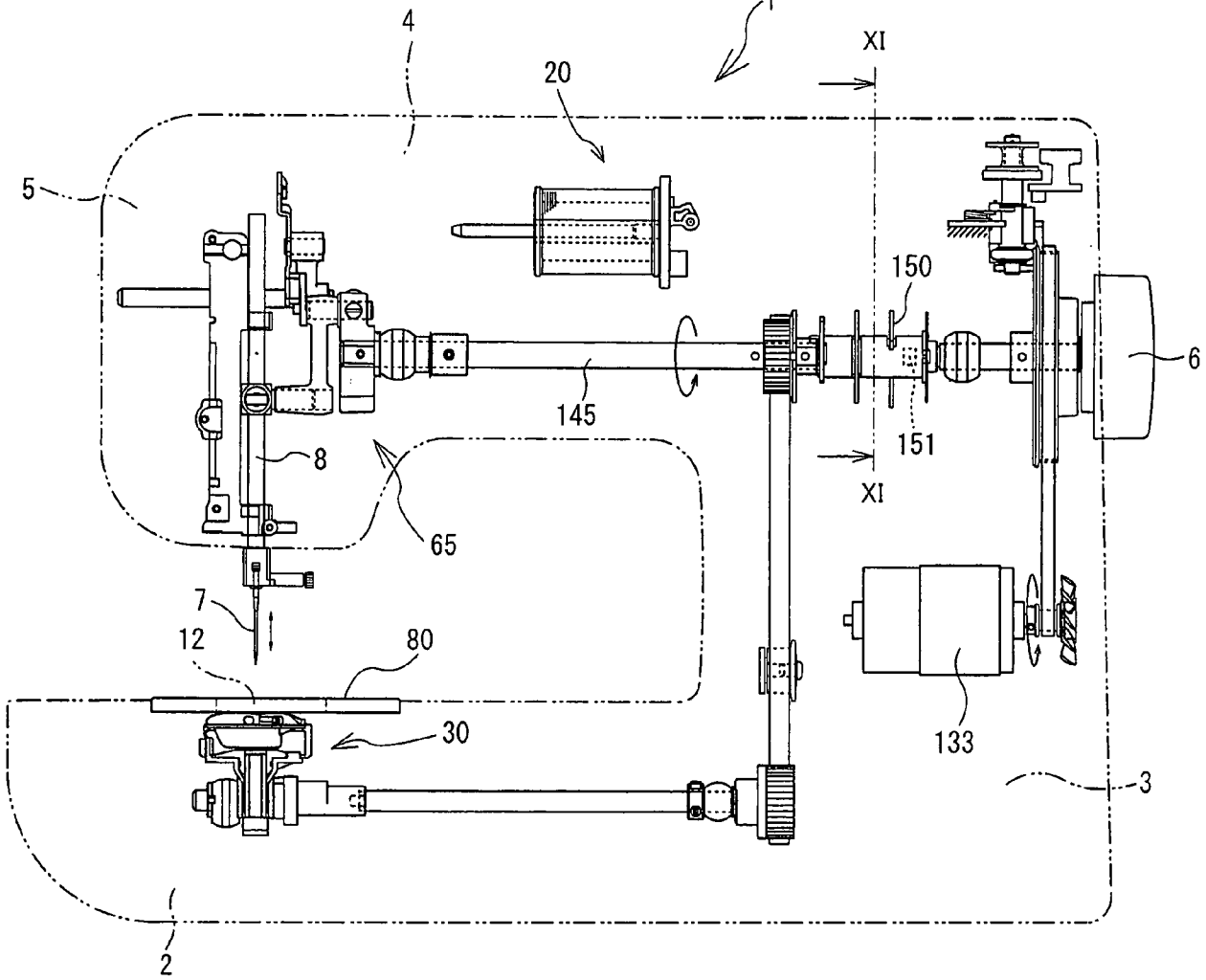
FIG. 3 is a view showing an internal structure of the sewing machine.
Figure 12:
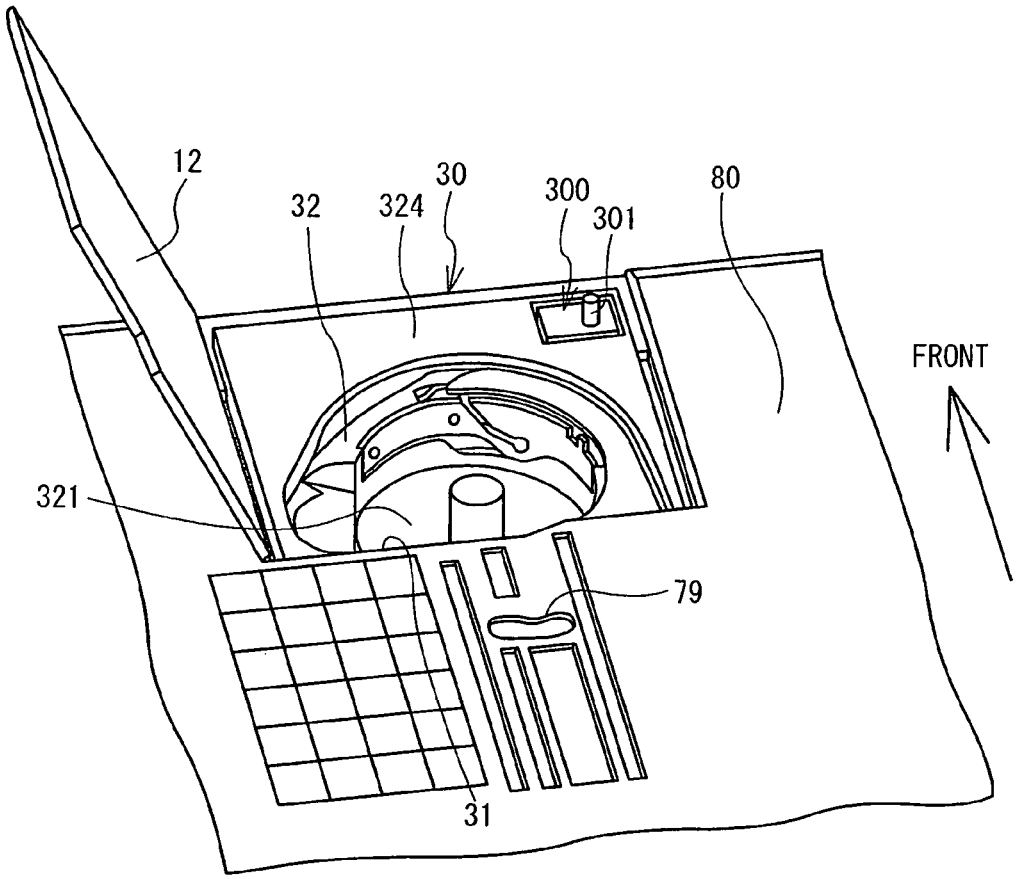
FIG. 12 is a perspective view of major components as viewed from a rear side of a needle plate.

As shown in FIG. 3, the needle plate 80 is provided at a position on the sewing machine bed 2 that faces the lower end of the sewing needle 7. Below the needle plate 80 in the sewing machine bed 2, a cloth feed mechanism (not shown) is mounted to drive feed dogs (not shown). A shuttle mechanism 30 is provided adjacent to the cloth feed mechanism. A needle plate lid 12 which can be opened and closed is provided above the shuttle mechanism 30. The user can attach or detach a bobbin (not shown) to or from the shuttle mechanism 30 while the needle plate lid 12 is opened as shown in FIG. 12.

As shown in FIG. 1, on a front surface of the pillar 3, a liquid crystal display (LCD) 10 equipped with a touch panel 16 is provided. The LCD 10 may display entry keys etc., which are used to enter a sewing pattern, sewing conditions, etc. By touching positions on the touch panel 16 corresponding to the entry keys etc., the user may select a sewing pattern, sewing conditions, etc.

As shown in FIG. 3, the sewing machine 1 contains a sewing machine motor 133, a drive shaft 145, a needle bar up-and-down movement mechanism 65, etc. The drive shaft 145 may be driven by the sewing machine motor 133 to be rotated. The needle bar up-and-down movement mechanism 65 may move up and down the needle bar 8 when the drive shaft 145 is rotated. A pulley 6 is provided at an upper part on a right side of the pillar 3. The pulley 6 may be used to rotate the drive shaft 145 manually, thereby moving the needle bar 8 up and down.

Figure 4:
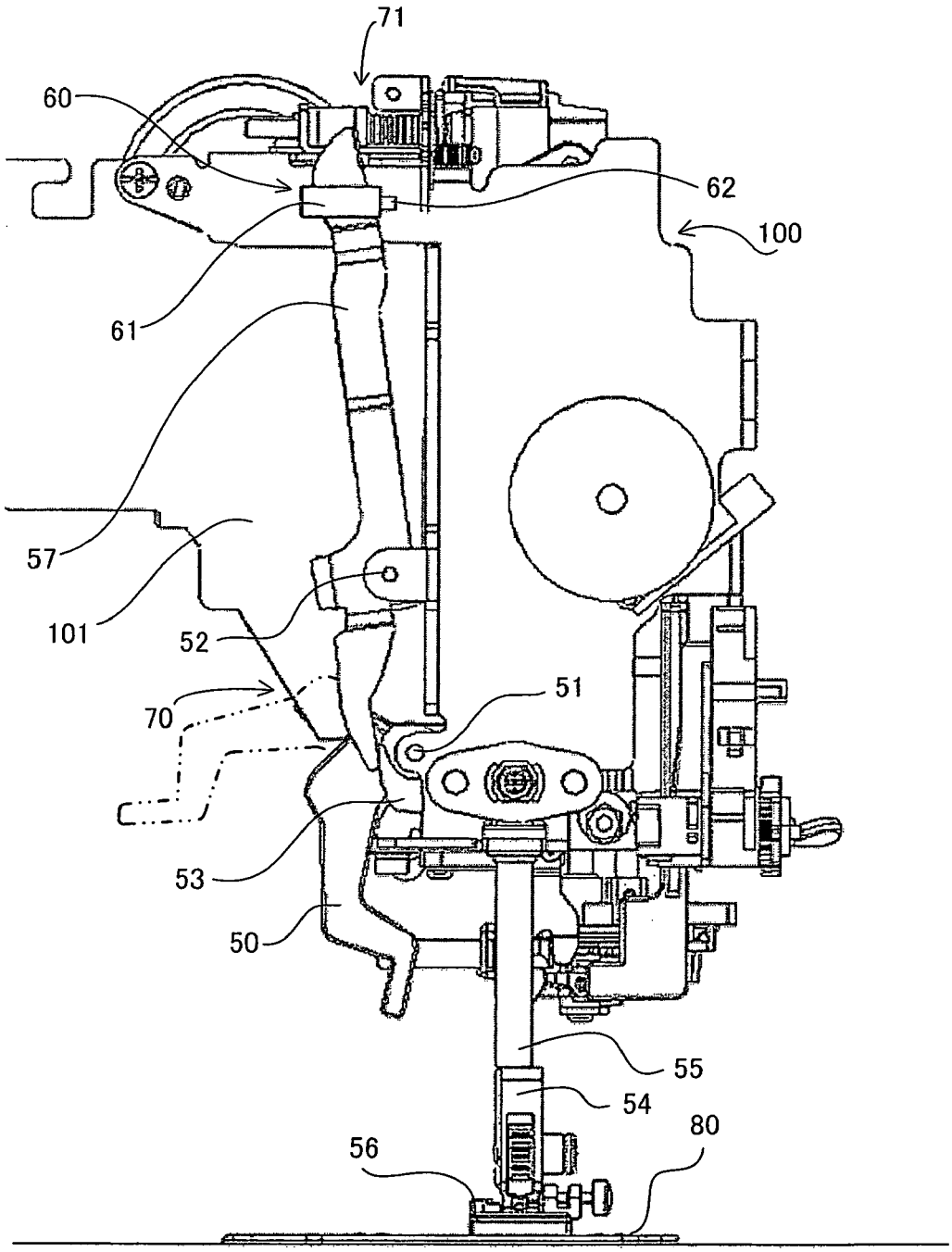
FIG. 4 is a rear view of the head portion with an exterior cover removed from the sewing machine.

A presser bar lifting mechanism 70 and a thread loosening mechanism 71 will be described with reference to FIG. 4. FIG. 4 shows a state where the presser foot 56 is lowered. A support frame 100 shown in FIG. 4 is fixed to a machine casing 101 of the sewing machine 1. The presser bar lifting mechanism 70 that raises and lowers the presser bar 55 is provided on the support frame 100. The presser bar lifting mechanism 70 is a mechanism with a known structure. The presser foot lever 50 is supported by a support shaft 51 to be swingable in the up-and-down direction. The support shaft 51 is fixed to the support frame 100. As the presser foot lever 50 is raised and lowered, the presser bar 55 moves the up and down. Therefore, the attachable-and-detachable presser foot 56, which is attached to the presser foot holder 54 fixed to the lower end of the presser bar 55, may also be raised and lowered.

Presser foots having various shapes may be prepared, corresponding to various types of sewing (stitch types). For example, a straight stitch foot, a zigzag foot, a buttonhole foot, an overcasting foot, a blind stitch foot, etc. may be prepared. The straight stitch foot may be used to sew straight stitches. The zigzag foot may be used to sew zigzag stitches. The buttonhole foot may be used to sew a buttonhole. The overcasting foot may used to sew overcasting stitches along an edge of a cut work cloth. The blind stitch foot may be used to sew blind stitches along a hem of a pair of pants or a skirt, for example. The user may appropriately replace the presser foot 56 in accordance with a sewing type employed in sewing. When replacing the presser foot 56, the user may lift the presser foot lever 50 to raise the presser foot 56. Then, the user may remove the attached presser foot 56 from the presser foot holder 54. Next, the user may prepare another type of presser foot 56 and attach the prepared presser foot 56 to the presser foot holder 54 as lowering the presser foot lever 50.

The thread loosening mechanism 71 is provided in the vicinity of the presser bar lifting mechanism 70. The thread loosening mechanism 71 may be used to release the tension applied to the needle thread (not shown) by the tensioner. The thread loosening mechanism 71 includes a thread loosening lever 57, a thread loosening cam 53, and a tension disc releasing lever (not shown). The thread loosening lever 57 is supported to be swingable by a support shaft 52 fixed to the support frame 100. The thread loosening cam 53 is formed integrally with the presser foot lever 50, and abuts against a lower end of the thread loosening lever 57. The tension disc releasing lever is coupled to the upper end of the thread loosening lever 57, and releases a hold by the pair of tension discs. If the presser foot lever 50 is lifted from a position indicated by a solid line to a position indicated by a two-dots-and-dash line in FIG. 4, the lower end portion of the thread loosening lever 57 is pressed by the thread loosening cam 53 and moves leftward. This causes the thread loosening lever 57 to swing clockwise around the support shaft 52. This in turn causes the tension disc releasing lever to release the hold of the needle thread by the pair of tension discs, thereby releasing the tension applied to the needle thread.

A detection switch 60 is provided at a position along a trajectory to be taken by the upper end of the thread loosening lever 57 when the thread loosening lever 57 swings. The detection switch 60 may detect whether or not the presser foot lever 50 is operated by detecting a swing of the thread loosening lever 57. Although not shown in detail, the detection switch 60 is fixed to the support frame 100. The detection switch 60 includes a body 61 and a lever portion 62 that projects from the body 61. A signal may be output in response to a movement of a tip of the lever portion 62.

Figure 5:
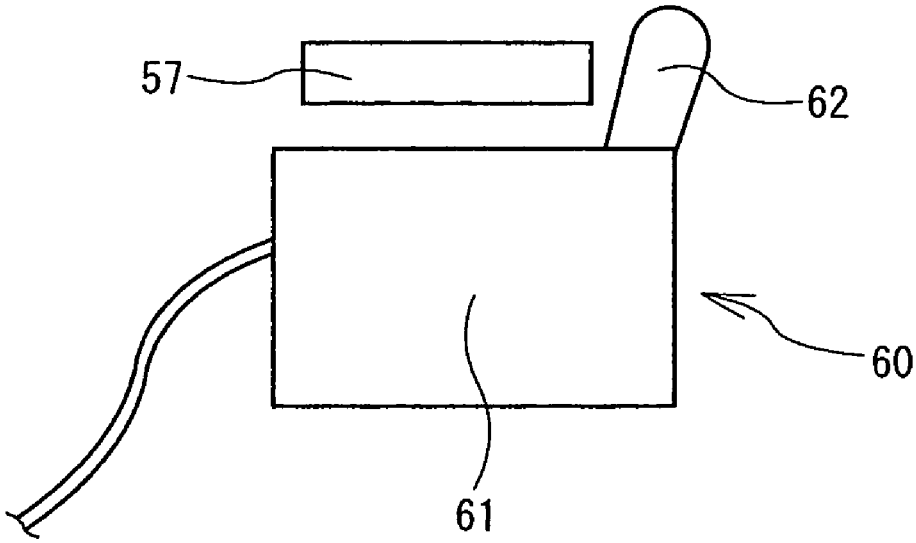
FIG. 5 is a schematic diagram of a detection switch in a condition where a presser foot is lowered.
Figure 6:
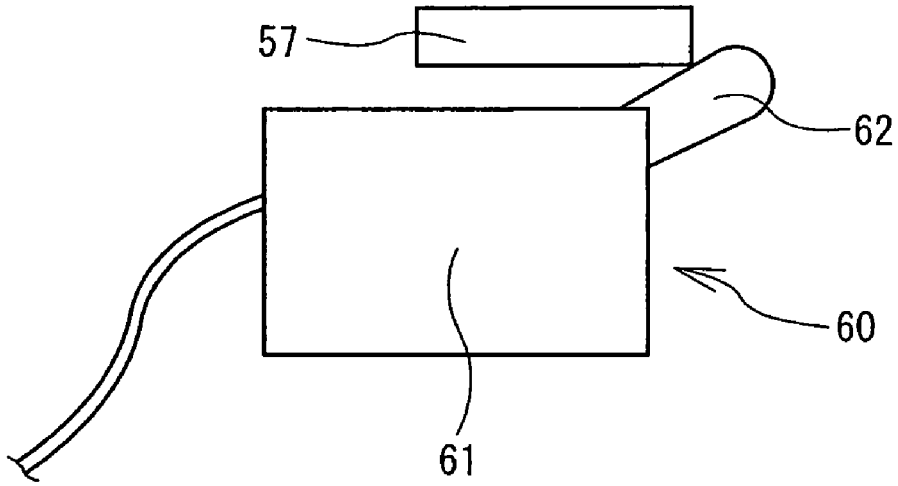
FIG. 6 is a schematic diagram of the detection switch in a condition where the presser foot is raised.

How the detection switch 60 detects an operation of the presser foot lever 50 will be described with reference to FIGS. 5 and 6. FIGS. 5 and 6 show the thread loosening lever 57 and the detection switch 60 shown in FIG. 4 in ground plan. As shown in FIG. 5, in a condition where the presser foot 56 is lowered, a right end portion of the thread loosening lever 57 is located a little away from the lever portion 62. If the user lifts the presser foot lever 50 from the position indicated by the solid line in FIG. 4, the thread loosening lever 57 moves rightward as shown in FIG. 6. As a result, the thread loosening lever 57 moves the tip of the lever portion 62 rightward, thereby changing a state of the detection switch 60 from OFF to ON. In such a manner, the operation of the presser foot lever 50 may be detected.

Figure 7:
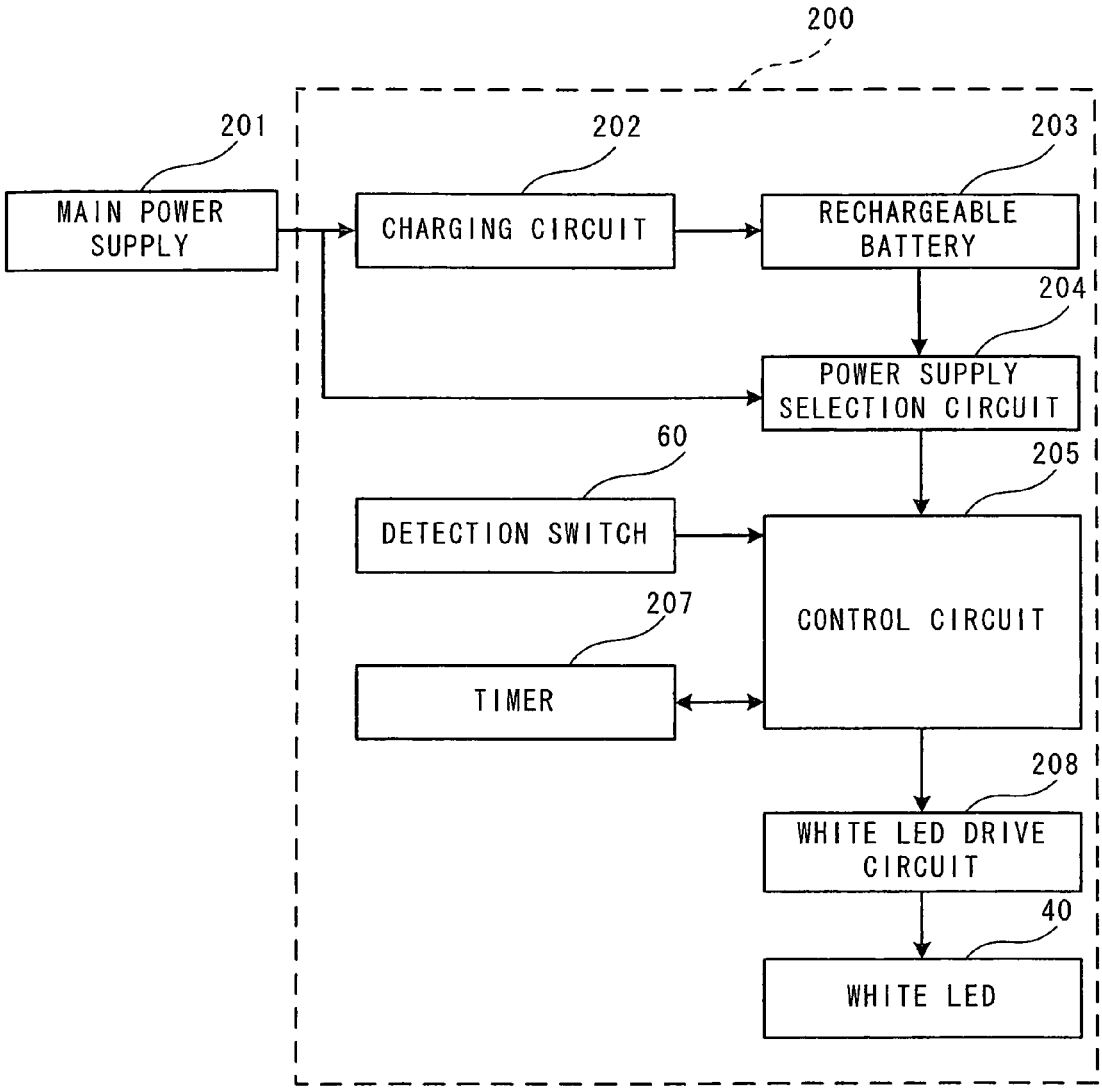
FIG. 7 is a block diagram showing an electrical configuration of an illuminating device of the sewing machine.

The electrical configuration of an illuminating device 200 will be described with reference to FIG. 7. A control device (not shown) that controls sewing operations of the sewing machine 1 may be mounted separately from the illuminating device 200. As shown in FIG. 7, the illuminating device 200 includes a charging circuit 202, a power supply selection circuit 204, a rechargeable battery 203, and a control circuit 205. The charging circuit 202 and the power supply selection circuit 204 may be supplied with power from a main power supply 201, which is an external power supply. The rechargeable battery 203 is connected to the charging circuit 202 and the power supply selection circuit 204. The power supply selection circuit 204, the detection switch 60, a timer 207, and a white LED drive circuit 208 are each connected to the control circuit 205. The white LED 40 is connected to the white LED drive circuit 208. The white LED drive circuit 208 controls turning-on and turning-off of the white LED 40. The white LED 40 illuminates the needle hole 79 in the needle plate 80 and the vicinity of the needle hole 79. The detection switch 60, if having detected the operation of the presser foot lever 50, outputs a signal to the control circuit 205. The timer 207 measures time in accordance with an instruction from the control circuit 205. Further, the timer 207 outputs the measured time in response to a request from the control circuit 205.

In a case where the sewing machine 1 is electrically in the on-state, power from the main power supply 201 may be supplied to the control circuit 205 via the power supply selection circuit 204. "The case where the sewing machine 1 is electrically in the on-state" refers to a condition in which power is being supplied from the main power supply 201. From the main power supply 201, power may also be supplied to the charging circuit 202. The supplied power may be stored in the rechargeable battery 203. In a case where the sewing machine 1 is electrically in the off-state, a source of power supplied to the control circuit 205 is switched to the rechargeable battery 203. "The case where the sewing machine 1 is electrically in the off-state" refers to a condition in which power supply from the main power supply 201 is turned off. In the present embodiment, as the rechargeable battery 203, a lithium ion battery may be employed. However, the rechargeable battery 203 to be employed is not limited to a lithium-ion battery. A nickel-hydrogen battery, a nickel-cadmium battery, a lead battery, etc. may be employed.

Figure 8:
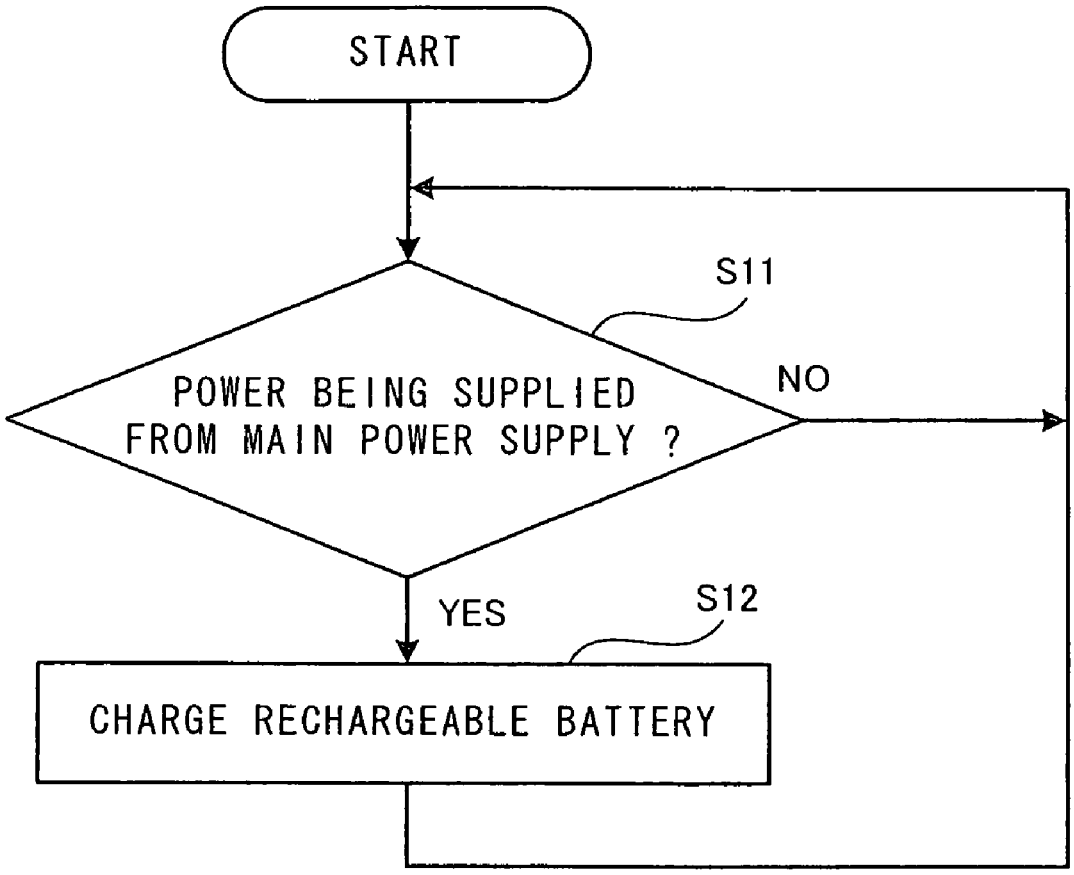
FIG. 8 is a flowchart showing operations of a charging circuit.
Figure 9:
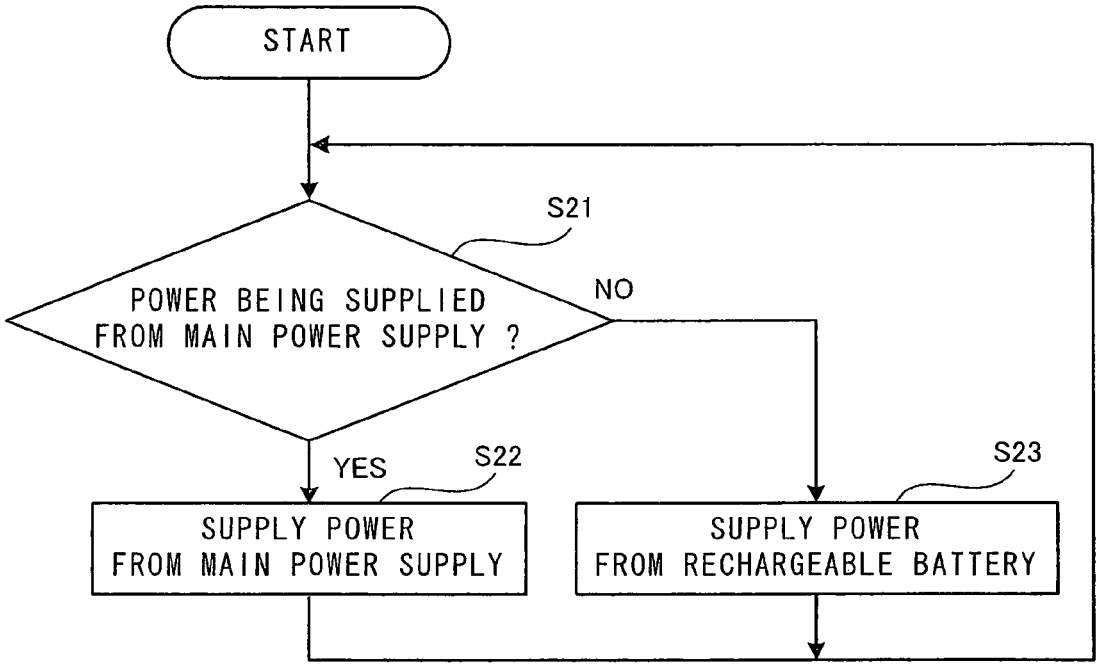
FIG. 9 is a flowchart showing operations of a power supply selection circuit.
Figure 10:
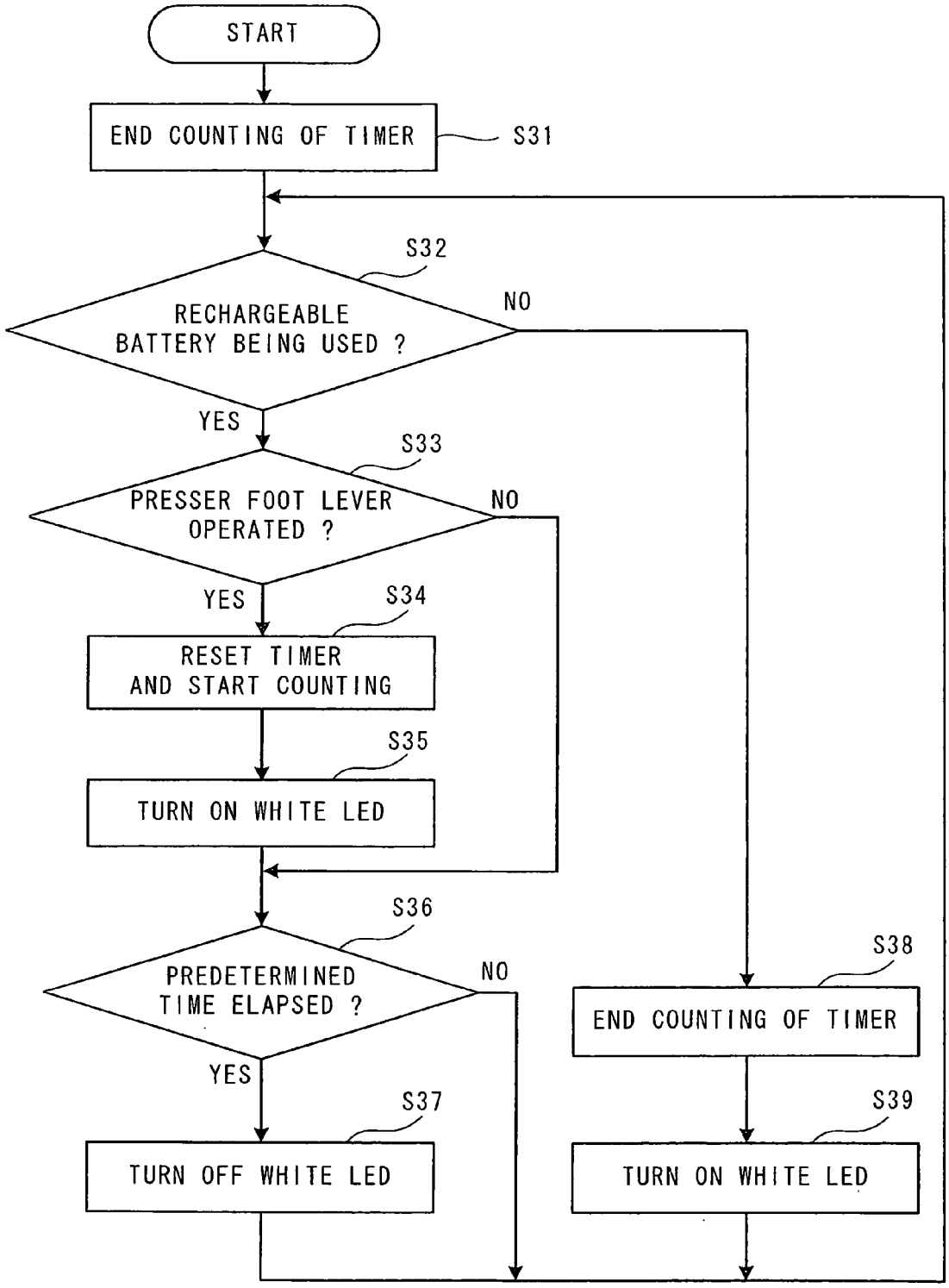
FIG. 10 is a flowchart showing operations of a control circuit.

Operations of the sewing machine illuminating device 200 will be described below with reference to flowcharts of FIGS. 8 to 10. Operations of the charging circuit 202 will be described with reference to a flowchart shown in FIG. 8. First, it is determined whether the charging circuit 202 is supplied with power from the main power supply 201 (S11). Specifically, if an output voltage of the main power supply 201 is 5V, for example, it may be determined whether the voltage of power supplied to the charging circuit 202 is 4V or larger. If the voltage is 4V or larger, it may be determined that power is being supplied from the main power supply 201. If the voltage is less than 4V, it may be determined that no power is being supplied from the main power supply 201. If the voltage is 4V or larger and it is determined that power is being supplied from the main power supply 201 (YES at S11), the rechargeable battery 203 is charged by power supplied from the main power supply 201 (S12). Then, the processing returns to step S11. If the voltage is less than 4V and it is determined that no power is being supplied from the main power supply 201 (NO at S11), the processing returns to step S11. Thus, while power is being supplied from the main power supply 201, the charging circuit 202 continues to charge the rechargeable battery 203.

Operations of the power supply selection circuit 204 will be described with reference to a flowchart shown in FIG. 9. First, it is determined whether the power supply selection circuit 204 is supplied with power from the main power supply 201 (S21). Specifically, if the output voltage of the main power supply 201 is 5V, for example, it may be determined whether the voltage of power supplied to the power supply selection circuit 204 is 4V or larger. If the voltage is 4V or larger, it may be determined that power is being supplied from the main power supply 201. If the voltage is less than 4V, it may be determined that no power is being supplied from the main power supply 201. If the voltage is 4V or larger and it is determined that power is being supplied from the main power supply 201 (YES at S21), power from the main power supply 201 is supplied to the control circuit 205, the white LED drive circuit 208, the white LED 40, the timer 207, and the detection switch 60 (S22). Then, the processing returns to step S21. If the voltage is less than 4V and it is determined that no power is being supplied from the main power supply 201 (NO at S21), power from the rechargeable battery 203 is supplied to the control circuit 205, the white LED drive circuit 208, the white LED 40, the timer 207, and the detection switch 60 (S23). Then, the processing returns to step S21. In such a manner, if no power is supplied from the main power supply 201, power is supplied from the rechargeable battery 203. Therefore, even if supply of power from the main power supply 201 is turned off, illuminating device 200 can operate to turn on the white LED 40. It should be noted that the value of the output voltage of the main power supply 201 is not limited to 5V. The value of the voltage to be used for determination regarding power supply to the charging circuit 202 and to the power supply selection circuit 204 is not limited to 4V. Those voltage values may be set appropriately.

Operations of the control circuit 205 will be described with reference to a flowchart shown in FIG. 10. Processing by the control circuit 205 may be performed in a condition where the control circuit 205 is being supplied with power from the main power supply 201 or the rechargeable battery 203. First, a count of the timer 207 is set to an end-state (S31). The timer 207 measures a time during which the white LED 40 stays on (hereinafter referred to as a "lighted time". In the present embodiment, if an instruction to end counting is given, a maximum countable value (for example, 99999 seconds) is set to the timer 207. The maximum countable value is greater than a value of a predetermined time, which will be described later. Next, it is determined whether the rechargeable battery 203 is being used as a power supply selected by the power supply selection circuit 204 (S32). If the rechargeable battery 203 is being used, a signal indicating that the rechargeable battery 203 is being used is sent from the power supply selection circuit 204 to the control circuit 205. If no signal is output to from the power supply selection circuit 204 to the control circuit 205 and thus it is determined that the rechargeable battery 203 is not being used (NO at S32), the count of the timer 207 is set to the end-state (S38). Then, an instruction of turning on the white LED 40 is output to the white LED drive circuit 208 (S39). Then, the processing returns to step S32.

If the signal is output to from the power supply selection circuit 204 to the control circuit 205 and it is determined that the rechargeable battery 203 is being used (YES at S32), it is determined whether the presser foot lever 50 has been operated (S33). If the state of the detection switch 60 has not been changed, that is, the detection switch 60 has remained in the ON-state or in the OFF-state, it is determined that the presser foot lever 50 has not been operated (NO at S33). Subsequently, it is determined whether the lighted time measured by the timer 207 has reached the predetermined time (S36).

On the other hand, if the state of the detection switch 60 has been changed from ON to OFF or OFF to ON, it is determined that the presser foot lever 50 has been operated (YES at S33). Subsequently, an instruction to start counting is given to the timer 207. The timer 207 is reset to a value of zero (0) and starts counting up (S34). Then, an instruction of turning-on is output to the white LED drive circuit 208 to turn on the white LED 40 (S35). Then, it is determined whether the time measured by the timer 207 has reached the predetermined time (for example, two or three minutes) (S36). That is, it is determined whether a time during which the white LED 40 is to be on has elapsed. Specifically, the time measured by the timer 207 is acquired and it is determined whether the acquired time is equal to or longer than the predetermined time. If it is determined that the time measured by the timer 207 is shorter than the predetermined time (NO at S36), the processing returns to step S32. It is then determined again whether the rechargeable battery 203 is being used (S32). On the other hand, if it is determined that the time measured by the timer 207 has reached the predetermined time (YES at S36), an instruction of turning-off is output to the white LED drive circuit 208 (S37). Then, the processing returns to step S32. It is then determined again whether the rechargeable battery 203 is being used (S32).

The operations performed by the control circuit 205 in a case where power is being supplied from the main power supply 201 to the sewing machine 1 will be described. Ordinarily, the sewing machine 1 is supplied with power from the main power supply 201. In such a case, as power is being supplied from the main power supply 201, the rechargeable battery 203 is not used (NO at S32). It is therefore unnecessary for the timer 207 to measure the time during which the white LED 40 is on, and so counting of the timer 207 is set to the end state (S38). Then, the white LED 40 is turned on (S39), and the processing returns to step S32. While power is being supplied from the main power supply 201, processing of steps S32 (NO), S38 and S39 may be repeated in this order. Therefore, while power is being supplied from the main power supply 201, the white LED 40 continues to be in the ON-state.

The operations performed by the control circuit 205 in a case where power supply from the main power supply 201 has been turned off and a source of power has been switched to the rechargeable battery 203. First, an example where the presser foot lever 50 is not operated by the user will be described. It should be noted that the timer 207 is maintained in the end state while power is being supplied from the main power supply 201. In the present example, since power is being supplied from the rechargeable battery 203 (YES at S32), it is determined whether the presser foot lever 50 has been operated (S33). In the present example, the presser foot lever 50 has not been operated (NO at S33) and the maximum countable value greater than the predetermined time has been set to the timer 207. Therefore, it is determined that the predetermined time has elapsed (YES at S36). Therefore, the instruction of turning-off the white LED 40 is output to the white LED drive circuit 208 (S37). Then, the processing returns to step S32. While the presser foot lever 50 is not operated, the processing of steps S32 (YES), S33 (NO), S36 (YES), and S37 may be repeated in this order. Thus, while the presser foot lever 50 is not operated by the user in a condition where power is being supplied from the rechargeable battery 203, the white LED 40 remains to be in the OFF-state.

The operations performed by the control circuit 205 in a case where the presser foot lever 50 has been operated by the user while power supply from the main power supply 201 has been turned off. In such a case, power is being supplied from the rechargeable battery 203 (YES at S32). Since the presser foot lever 50 has been operated (YES at S33), the timer is reset to 0 to start counting up (S34). The white LED 40 is turned on (S35). Then, it is determined whether the time measured by the timer 207 has reached the predetermined time (S36). Because the timer has just been reset to 0 to start counting up at S34, it is determined that the time measured by the timer 207 is less than the predetermined time (NO at S36). Then the processing returns to step S32.

If the presser foot lever 50 has been operated again (YES at S33) while power is still being supplied from the rechargeable battery 203 (YES at S32), the timer is reset to 0 to start counting up again (S34). Then, the white LED 40 is turned on (S35). The predetermined time has not elapsed (NO at S36). If the presser foot lever 50 has been operated continuously (YES at S32), the processing of steps S32 (YES), S33 (YES), S34, S35, and S36 (NO) may be repeated in this order. In such a manner, as far as the presser foot lever 50 is operated repeatedly (YES at S33), the timer is reset to 0 to start counting up (S34). Therefore, the predetermined time will not have elapsed (NO at S36). Therefore, the white LED 40 will not be turned off at step S37. In other words, the white LED 40 will not be turned off while the user is operating the presser foot lever 50. As long as the presser foot lever 50 is being operated repeatedly, the white LED 40 remains in the ON-state. Therefore, the user may not need to perform any other operations in order to turn on the white LED 40, and may be able to replace the presser foot 56 efficiently.

If the presser foot lever 50 is not operated any longer (NO at S33), the timer will not be reset to start counting up. Therefore, the timer 207 continues to measure the time. Until the predetermined time has elapsed since the presser foot lever 50 was operated last time (NO at S36), the processing of steps S32 (YES), S33 (NO), and S36 (NO) may be repeated in this order. Then, if the predetermined time has elapsed (YES at S36), the white LED 40 is turned off (S37). Then, the processing of steps S32 (YES), S33 (NO), S36 (YES), and S37 may be repeated in this order. Therefore, even if power is being supplied from the rechargeable battery 203, the white LED 40 may be turned off when the user stops operating the presser foot lever 50.

In such a manner, in the sewing machine 1 of the present embodiment, if power supply from the main power supply 201 is turned off, power may be supplied from the rechargeable battery 203, instead. If the presser foot lever 50 is operated, the detection switch 60 may detect the operation of the presser foot lever 50. Power may be supplied from the rechargeable battery 203 to turn on the white LED 40. Therefore, even if the main power supply 201 is turned off in order to ensure safety of the user, the white LED 40 may be turned on, if the user operates the presser foot lever 50 to be raised. Therefore, the user can easily replace the presser foot 56 in a condition where the needle hole 79 in the needle plate 80 and the vicinity of the needle hole 79, that is, the vicinity of the user's hands, is sufficiently illuminated.

The lighted time is measured by the timer 207, and the white LED 40 may be turned off when the measured time has reached the predetermined time. As a result, the white LED 40 may not stay ON longer than necessary, using power from the rechargeable battery 203. Thus, it may be possible to suppress wasteful consumption of power supplied from the rechargeable battery 203.

If the presser foot lever 50 is operated again while the lighted time is measured by the timer 207, the timer 207 is reset and starts measurement of the lighted time again. Thus, it may be possible to keep the white LED 40 ON. As a result, even when the predetermined time has elapsed since the first start of the measurement, the white LED 40 may stay ON while the user is working. Therefore, the user can work in a condition where the needle hole 79 in the needle plate 80 and the vicinity of the needle hole 79 are sufficiently illuminated.

The sewing machine of the present disclosure is not limited to the embodiment described above, but can be modified variously within the range not departing from the gist of the present disclosure. The above-described embodiment employs the rechargeable battery 203, which is a secondary battery that can be recharged, as a power supply that supplies power to the control circuit 205, the white LED drive circuit 208, the white LED 40, the timer 207, and the detection switch 60 while the main power supply 201 is turned off. However, as the power supply to supply power, a primary battery such as a dry cell that cannot be recharged or a capacitor such as an electric double-layer capacitor may be employed.

In the embodiment above, the detection switch 60 detects that the presser foot lever 50 has been operated. Specifically, the detection switch 60 detects a swing of the upper end portion of the thread loosening lever 57. However, the position where the detection switch 60 is mounted is not limited to the vicinity of the upper end portion of the thread loosening lever 57. The detection switch 60 may need to be disposed to such a position where the detection switch 60 can detect the swing of the thread loosening lever 57. Instead of detecting the swing of the thread loosening lever 57, the movement of the presser foot lever 50 or the presser bar 55 may be detected. A magnetic sensor such as a reed switch or an optical sensor such as a photo-interrupter may be employed as the detection switch 60.

Figure 11:
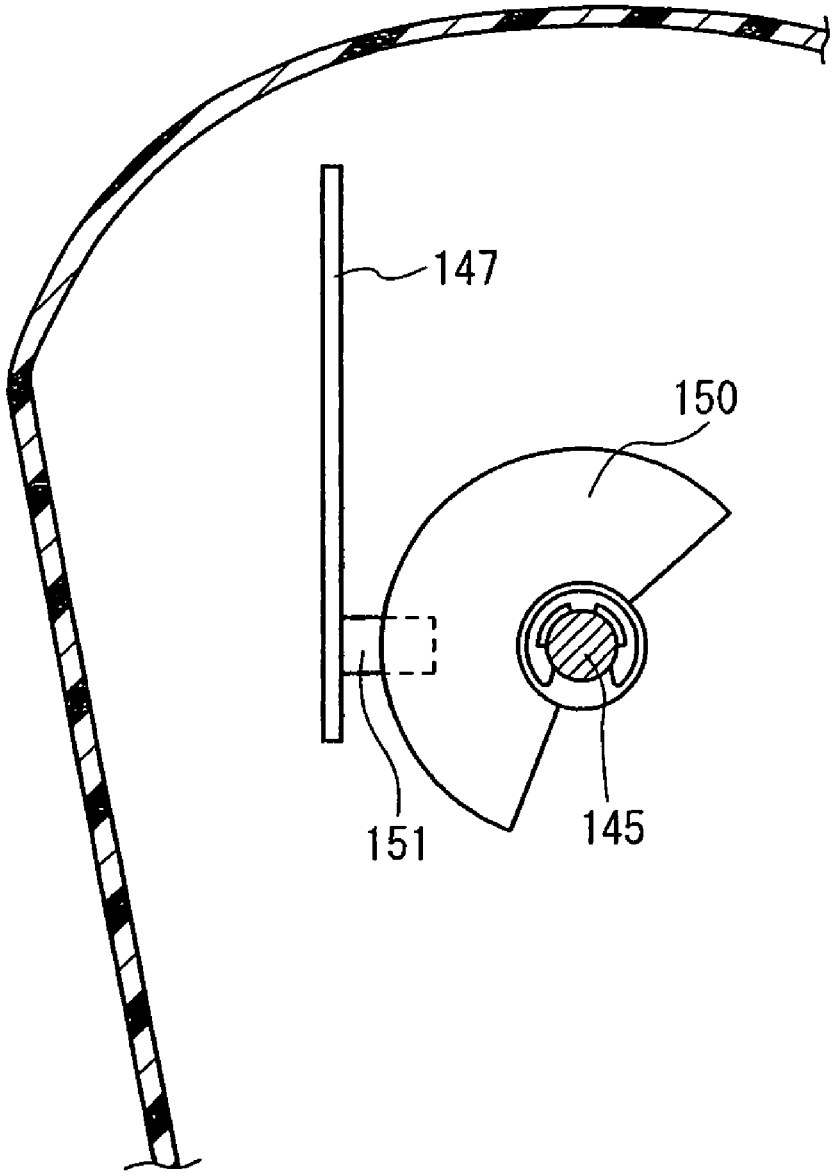
FIG. 11 is a cross-sectional view taken along line XI-XI of FIG. 3 as viewed in an arrow direction.

In the embodiment above, the operation of the presser foot lever 50 is detected. However, an operation to be detected is not limited to the operation of the presser foot lever 50. For example, a manual operation of the pulley 6 to move the needle bar 8 up and down may be detected. An example of detecting the operation of the pulley 6 will be described with reference to FIGS. 3 and 11. A photo-sensor 151 shown in FIG. 111 may be used to detect the operation of the pulley 6. The photo-sensor 151 may be disposed to detect a rotation of the drive shaft 145. If the user manually rotates the pulley 6 shown in FIG. 3, the rotation is transmitted to the drive shaft 145, which in turn causes the needle bar up-and-down movement mechanism 65 to move the needle bar 8 up and down. The drive shaft 145 is provided with a rotary shutter 150, as shown in FIG. 11. The rotary shutter 150 includes a shield plate that is fan-shaped in a side view. The photo-sensor 151 is provided on a support frame 147 of the sewing machine 1. The photo-sensor 151 may optically detect a rotation of the rotary shutter 150. By using the photo-sensor 151, the operation of the pulley 6 can be detected.

The user may need to move the needle bar 8 upward in order to replace the sewing needle 7 or pass a needle thread through an eye (not shown) of the sewing needle 7. In such a case, if the needle bar 8 is not at a raised position, the user may rotate the pulley 6 manually to move the needle bar 8 upward. If the user rotates the pulley 6 manually, the rotation of the rotary shutter 150 may be detected by the photo-sensor 151. Therefore, even when the main power supply 201 of the sewing machine 1 has been turned off to ensure safety of the user, the needle hole 79 in the needle plate 80 and its vicinity may be illuminated by the white LED 40. Therefore, the needle hole 79 in the needle plate 80 and its vicinity, that is, the vicinity of the hands of the user, can be sufficiently illuminated, so that the user can work easily. If the user operates the pulley 6 again before the predetermined time elapses, the lighted time of the white LED 40 may be prolonged. Therefore, while the user is working, the white LED 40 stays ON, so that the user may continue the work in a condition where the vicinity of the user's hands is sufficiently illuminated.

Further, an operation of opening or closing the needle plate lid 12 may be detected. As shown in FIG. 12, the needle plate lid 12 may cover a bobbin housing opening 31 that contains a bobbin (not shown) around which a needle thread is wound. An example of detecting operations of opening or closing the needle plate lid 12 will be described with reference to FIG. 12. The shuttle mechanism 30 is configured in such a manner that a known horizontal shuttle is disposed below the needle plate 80. The horizontal shuttle includes an outer shuttle (not shown) and an inner shuttle 32. The outer shuttle may horizontally rotate in synchronization with the up-and-down movement of the needle bar 8. The inner shuttle 32 is contained in the outer shuttle and has a housing portion 321 located under the bobbin housing opening 31. An attachable-and-detachable bobbin may be fit into the housing portion 321.

An inner shuttle presser plate 324 is mounted above the inner shuttle 32. Over the inner shuttle presser plate 324, the needle plate lid 12 to cover the bobbin housing opening 31 may be placed. Although not shown in detail, the needle plate 80 includes a locking mechanism and an operation member. The locking mechanism locks the needle plate lid 12 to an upper surface of the inner shuttle presser plate 324. The operation member may be used to release locking made by the locking mechanism. The needle plate lid 12 is provided to the needle plate 80 so that the needle plate lid 12 can be opened and closed. A detection switch 300 may be disposed at a front portion of the inner shuttle presser plate 324. The detection switch 300 may detect whether the needle plate lid 12 is opened or closed. The detection switch 300 may be a known push switch. The detection switch 300 may detect the condition of a projection 301 that projects from the detection switch 300. If the needle plate lid 12 is closed, the projection 301 is pressed down. If the needle plate lid 12 is opened, the projection 301 projects upwards. In such a manner, the operation of opening and closing the needle plate lid 12 may be detected by the detection switch 300.

During a replacement of a bobbin by the user, the main power supply 201 may be turned off in order to ensure safety of the user. In such a case, if the user opens the needle plate lid 12, the detection switch 300 may detect the opening and closing operation of the needle plate lid 12. Then, the needle plate 80 and the vicinity thereof will be illuminated by the white LED 40. Therefore, the user can easily work, because the needle hole 79 in the needle plate 80 and its vicinity, that is, the vicinity of the user's hands is sufficiently illuminated.

If the user opens or closes the needle plate lid 12 again before the predetermined time elapses, the lighted time of the white LED 40 may be prolonged. Therefore, while the user is working, the white LED 40 stays ON, so that the user may continue the work in a condition where the vicinity of the user's hands is sufficiently illuminated. In the above example, the detection switch 300 is of a push type. However, the detection switch 300 to be used may be any one of other various sensors, such as a photo-sensor that optically detects the presence and absence of an object.

Figure 13:
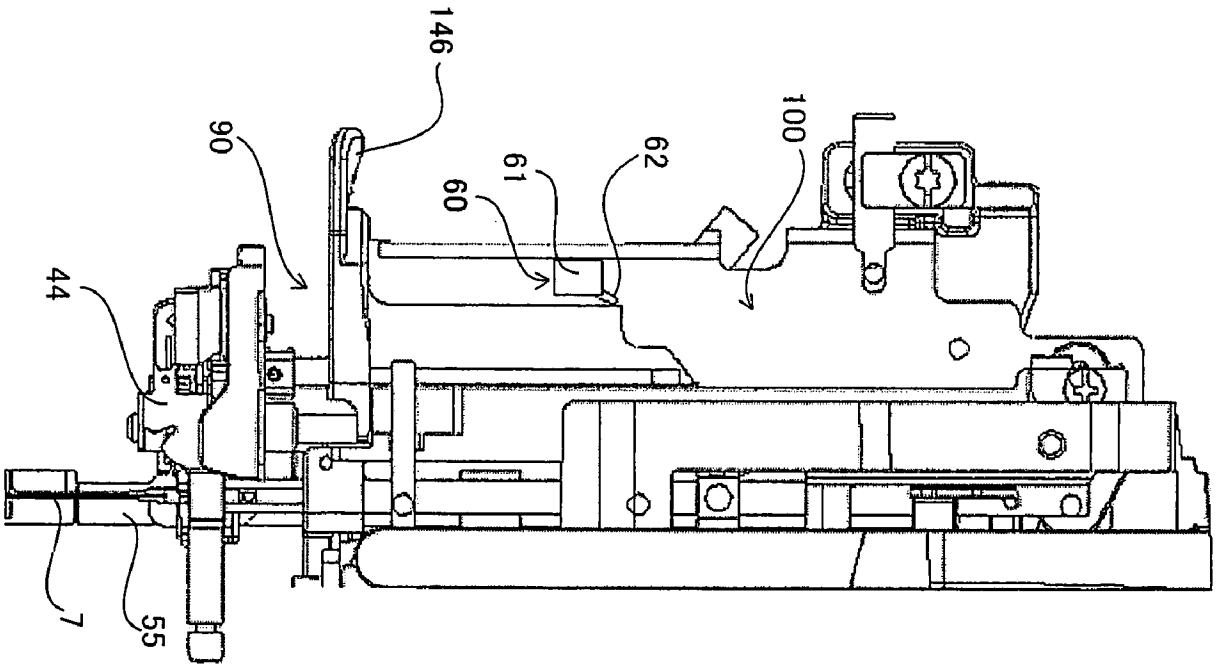
FIG. 13 is a front view of the major components of a threading device.

An operation of a threading lever 146 that moves a threading device 90 shown in FIG. 13 may be detected. An example of detecting the operation of the threading lever 146 will be described with reference to FIG. 13. The threading device 90 is a known device that is configured to pass a needle thread through the eye (not shown) of the sewing needle 7. The threading lever 146 that operates the threading device 90 is supported in such a manner that the threading device 90 can be moved up and down. The threading lever 146 is urged upward by a spring (not shown) to stay at an upper standby position. If the user presses down the threading lever 146 against a spring force of the spring, a thread guide portion 44 and a threading hook (not shown) may be moved downward by a predetermined distance. Then, as the thread guide portion 44 and the threading hook swing by a predetermined angle, the needle thread may be passed through the eye of the sewing needle 7. The detection switch 60 may be fixed to the support frame 100 so that the detection switch may detect the operation of the threading lever 146. If the threading lever 146 rests at the upper standby position, the detection lever portion 62 of the detection switch 60 comes in contact with the threading lever 146.

If the user presses down the threading lever 146, the lever portion 62 of the detection switch 60 goes out of contact with the threading lever 146. In such a manner, the operation of the threading lever 146 may be detected by the detection switch 60. As a result, in the case of passing a needle thread through the eye of the sewing needle 7 by using the threading device 90, the white LED 40 will illuminate the needle hole 79 in the needle plate 80 and its vicinity, that is, the vicinity of the user's hands, even when power supply has been turned off from the main power supply 201 of the sewing machine 1 in order to ensure safety. Because the hands of the user and the vicinity thereof are sufficiently illuminated, the user can work easily. If the user operates the threading lever 146 again before the predetermined time elapses, the lighted time of the white LED 40 may be prolonged. Therefore, while the user is working, the white LED 40 stays ON, so that the user can work in a condition where the vicinity of the user's hands is sufficiently illuminated.

The operations of the presser foot lever 50, the pulley 6, and the threading lever 146 are described above as the operations to be detected in the sewing machine 1. Any one of the operations of the presser foot lever 50, the pulley 6, and the threading lever 146 may be detected. All of the operations of the presser foot lever 50, the pulley 6, and the threading lever 146 may also be detected. Some of the operations of the presser foot lever 50, the pulley 6, and the threading lever 146 may be detected.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine that operates with power supplied from a main power supply, comprising:

a needle plate having a needle hole through which a sewing needle can pass;

an illuminating device that illuminates the needle hole and a vicinity of the needle hole;

a power supply device that stores power;

a detection device that detects whether a predetermined operation is performed in the sewing machine;

a power distribution device that supplies the power from the power supply device to the detection device and the illuminating device, when supply of the power from the main power supply is turned off; and a turning-on device that turns on the illuminating device, when the detection device detects that the predetermined operation is performed in a condition where the supply of the power from the main power supply is turned off.

2. The sewing machine according to claim 1, wherein the predetermined operation is an operation of a presser foot lever, the presser foot lever being configured to raise or lower a presser bar which a presser foot can be attached to and detached from.

3. The sewing machine according to claim 1, further comprising:

a measurement device that measures a lighted time, the lighted time being a period of time during which the illuminating device remains illuminated because of the supply of the power from the power supply device; and a turning-off device that turns off the illuminating device, when the lighted time measured by the measurement device reaches a predetermined time.

4. The sewing machine according to claim 3, further comprising:

a measurement control device that causes the measurement device to restart measuring of the lighted time, when the detection device detects that the predetermined operation is performed while the lighted time is being measured by the measurement device.

5. The sewing machine according to claim 1, wherein the illuminating device is a light emitting diode.

6. A non-transitory computer-readable medium storing a computer-executable control program executable in a sewing machine that operates with power supplied from a main power supply, the program comprising instructions for:

causing a power supply device that stores power to supply the stored power to a detection device and an illuminating device that are provided in the sewing machine, the detection device being configured to detect whether a predetermined operation is performed in the sewing machine, and the illuminating device being configured to illuminate a needle hole and a vicinity thereof, the needle hole being a hole formed in a needle plate through which a sewing needle can pass; and turning on the illuminating device, when it is detected that the predetermined operation is performed in a condition where the main power supply is turned off.

7. The non-transitory computer-readable medium according to claim 6, wherein the predetermined operation is an operation of a presser foot lever, the presser foot lever being configured to raise or lower a presser bar which a presser foot can be attached to and detached from.

8. The non-transitory computer-readable medium according to claim 6, wherein the program further comprises instructions for:

measuring a lighted time, the lighted time being a period of time during which the illuminating device remains illuminated because of the supply of the power from the power supply device; and turning off the illuminating device, when the lighted time measured reaches a predetermined time.

9. The non-transitory computer-readable medium according to claim 8, wherein the program further comprises instructions for:

restarting the measuring of the lighted time, when it is detected that the predetermined operation is performed while the lighted time is being measured.

* * * * *